US009505581B2

(12) United States Patent
Kai et al.

(10) Patent No.: US 9,505,581 B2
(45) Date of Patent: Nov. 29, 2016

(54) POST-PROCESSING APPARATUS AND IMAGE FORMING SYSTEM INCLUDING THE POST-PROCESSING APPARATUS

(71) Applicant: CANON KABUSHIKI KAISHA, Tokyo (JP)

(72) Inventors: Teruhito Kai, Kashiwa (JP); Shinnosuke Iwadate, Toride (JP); Hiroto Nishihara, Tsukuba (JP); Kenzo Kumagai, Toride (JP); Hiromi Shimura, Toride (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/789,133

(22) Filed: Jul. 1, 2015

(65) Prior Publication Data

US 2016/0002002 A1 Jan. 7, 2016

(30) Foreign Application Priority Data

Jul. 3, 2014 (JP) ..... 2014-137574

(51) Int. Cl.

*B65H 43/00* (2006.01)
*B65H 37/04* (2006.01)
*G03G 15/00* (2006.01)

(52) U.S. Cl.

CPC ..... *B65H 43/00* (2013.01); *B65H 37/04* (2013.01); *G03G 15/6582* (2013.01); *B65H 2408/1222* (2013.01); *B65H 2801/27* (2013.01); *G03G 2215/00392* (2013.01); *G03G 2215/00827* (2013.01); *G03G 2221/1696* (2013.01)

(58) Field of Classification Search

CPC ... B65H 43/00; B65H 37/04; B65H 2407/21
See application file for complete search history.

(56) References Cited

U.S. PATENT DOCUMENTS 4,986,520 A * 1/1991 Shido ..... B42B 4/00 270/58.14
5,447,297 A * 9/1995 Murata ..... B42C 1/125 270/58.02
5,542,655 A * 8/1996 Murakami ..... B42C 1/12 270/58.09
5,752,694 A * 5/1998 Yamashita ..... B65H 29/60 270/58.12
7,568,510 B2 8/2009 Nagaya et al.

(Continued)

FOREIGN PATENT DOCUMENTS

JP 2009-018932 A 1/2009
JP 2009018932 A * 1/2009

OTHER PUBLICATIONS

U.S. Appl. No. 14/870,560, filed Sep. 30, 2015.

*Primary Examiner* — Patrick Cicchino
(74) *Attorney, Agent, or Firm* — Fitzpatrick, Cella, Harper & Scinto

(57) ABSTRACT

A post-processing apparatus which can respectively balance the convenience of the user using a manual staple and convenience of the user using an online staple is provided. A finisher includes a stapler for performing predetermined post-processing on a sheet received and a control unit. The control unit switches between a first control mode which is allowed to perform predetermined post-processing on the sheet received from an image forming apparatus and a second control mode which is allowed to perform predetermined post-processing on the sheet received not via the image forming apparatus. In addition, the control unit controls the switching such that the second control mode is switched to the first control mode after a lapse of a first predetermined period.

11 Claims, 8 Drawing Sheets

(56) References Cited

U.S. PATENT DOCUMENTS 8,947,691 B2 * 2/2015 Ishizuka ..... G06K 15/404 358/1.13
9,323,205 B2 * 4/2016 Mine ..... G03G 15/6544
2011/0031675 A1 * 2/2011 Terao ..... B27F 7/006 270/58.02
2011/0031677 A1 * 2/2011 Ozawa ..... B65H 29/34 270/58.12
2011/0062647 A1 * 3/2011 Tsuchiya ..... B42B 4/00 270/58.09
2014/0138896 A1 * 5/2014 Yoshida ..... G03G 15/6544 270/58.11
2014/0362396 A1 * 12/2014 Ishizuka ..... G06K 15/404 358/1.13

* cited by examiner

POST-PROCESSING APPARATUS AND IMAGE FORMING SYSTEM INCLUDING THE POST-PROCESSING APPARATUS

BACKGROUND OF THE INVENTION

Field of the Invention

The present disclosure relates to a post-processing apparatus for binding a sheet bundle formed of a plurality of sheets and an image forming system including the post-processing apparatus.

Description of the Related Art

Conventionally, as an optional device of an image forming apparatus, a sheet processing apparatus which receives sheets delivered from the image forming apparatus and performs stapling post processing on the sheet bundle received (post-processing apparatus) is commonly used. Further, some of the sheet processing apparatuses of this kind include functions such as an online stapling function, which is automatically executed as a part of a print job, and a manual stapling function, through which a user manually inserts a sheet bundle into an opening which is open outside the apparatus and performs stapling processing on the sheet bundle. In such a sheet processing apparatus, in addition to the online stapling function, it is required to have the manual stapling function as an additional function and to reduce cost needed to manufacture the sheet processing apparatus body.

For example, Japanese Patent Application Laid-open No. 2009-018932 discloses a sheet post-processing apparatus, in which a stapler device is movable to a first position where online stapling processing is executed and to a second position where manual stapling processing is executed. Thereby, one stapler device, which is expensive, can be commonly used both in an online stapling function and in a manual stapling function. This enables to reduce manufacturing cost of the sheet processing apparatus body and provide an additional value to a user.

For example, suppose one stapler device is used both as the online stapling function and the manual stapling function. In this case, while the stapler device stays at a position where the manual stapling is executed (for example, the second position as above), it is not possible to execute the online stapling. Further, there may be a case where, though the stapler device stays at a position where the manual stapling processing is executed, a sheet bundle is not inserted into a stapler even after a lapse of predetermined period (timeout period). In this case, it is generally known to control to move the stapler device automatically at a position where the online stapling processing is executed (for example, the first position as above) after a lapse of the timeout period to make the stapler device stand by in that state.

On the other hand, it sometimes takes time to automatically move the stapler device, from a state after the manual staple is used by a user, to a position where the online stapling is to be performed. In addition, the user wishing to use the online stapling has to waste time until the stapler device moves to the position. The longer it takes time to move, the more uselessly the user has to wait, which is a problem. It means that the length of the timeout period which is previously set closely relates to the user's usability and convenience.

The main object of the present disclosure is to provide a post-processing apparatus which can respectively balance the convenience of the user using the manual staple and the convenience of the user using the online staple. Further, an image-forming apparatus including the post-processing apparatus is provided.

SUMMARY OF THE INVENTION

The post processing apparatus according to the present disclosure comprises a post-processing unit configured to perform predetermined post-processing on a sheet; and a control unit configured to switch between a first control mode and a second control mode. The first mode is a mode for performing the predetermined post-processing on a sheet which is conveyed from the image forming apparatus, and the second control mode is a mode for performing the predetermined post-processing on a sheet which is manually inserted into the post-processing apparatus, and the control unit is further configured to control the switching such that the second control mode is switched to the first control mode after a lapse of a first predetermined period from completion of the post-processing in the second control mode, wherein the control unit is further configured to switch, when it is in the second control mode, to the first control mode after a lapse of a second predetermined period, which is shorter than the first predetermined period, in a case where the control unit receives a notification from the image forming apparatus notifying to perform an image formation to which post-processing in the first control mode is specified.

Further features of the present invention will become apparent from the following description of exemplary embodiments (with reference to the attached drawings).

DESCRIPTION OF THE EMBODIMENTS

In the following, embodiments are described with reference to the accompanying drawings.

Figure 1:
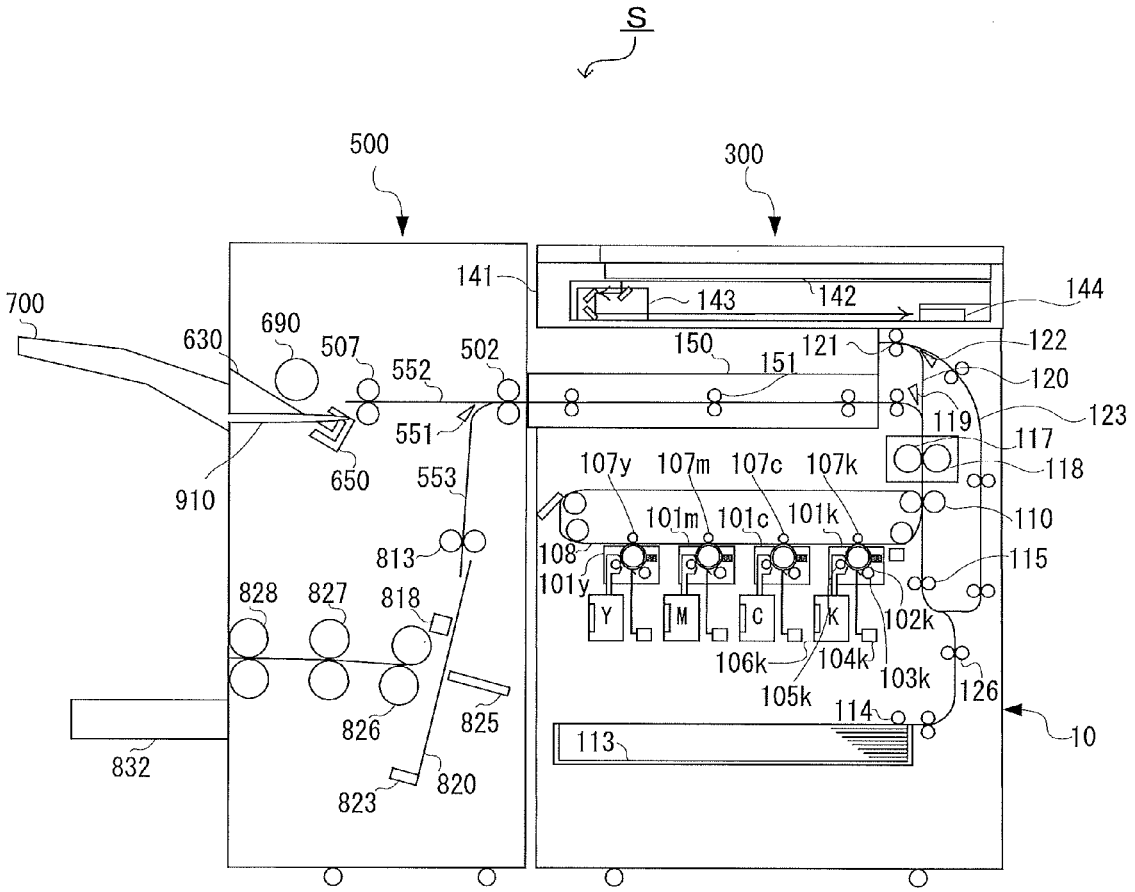
FIG. 1 is a schematic longitudinal sectional view illustrating one example of a configuration of an image forming system including an image forming apparatus and a finisher, which is one example of a post-processing apparatus.

FIG. 1 is a schematic longitudinal sectional view illustrating a configuration example of an image forming system including an image forming apparatus and a finisher, which is one example of a post-processing apparatus. An image forming apparatus 300 included in an image forming system S shown in FIG. 1 comprises a printer section 10. The printer section 10 includes process units 101*k*, 101*y*, 101*m*, and 101*c*, which respectively are the process units of black, yellow, magenta, and cyan colors. It is noted that each process unit comprises a photosensitive drum, a developing device, a charging roller, and the like.

In the following, description is given with regard to a photosensitive drum 102*k*, a charging roller 103*k* and a developing device 105*k* included in the black process unit 101*k*.

The photosensitive drum 102*k* is arranged at a center of the process unit 101*k* shown in FIG. 1, which is rotationally driven by a drum motor (not shown). Applying the high voltage, the charging roller 103*k* uniformly charges the surface of the photosensitive drum 102*k*. A laser scanner unit 104*k* scans laser, which is modulated and output from a laser diode, in a longitudinal direction using a polygon mirror rotator. Thereby, the laser is exposed on the uniformly charged photosensitive drum 102*k* according to input image information to form an electrostatic latent image. The developing device 105*k* forms a visible toner image according to the electrostatic latent image on the photosensitive drum using two-component developer including a toner and a carrier. A toner bottle 106*k* is a bottle in which the toner is filled, which supplies the toner to the developing device 105*k*. A primary transfer roller 107*k* transfers the toner image formed on the photosensitive drum 102*k* to an intermediate transfer body 108.

It is noted that the process units 101*y* to 101*c* are identically configured to the process unit 101*k*. Also, it is noted that the description of the photosensitive drum 102, the charging roller 103, and the developing device 105 in the following means to include the description of those of the yellow, magenta, cyan and black colors.

The toner image having transferred to the intermediate transfer body 108 is transferred to a sheet (for example, paper) by a secondary transfer roller 110.

The sheet is stored in a sheet cassette 113. When the toner image is transferred to the sheet, a sheet feeding roller 114 feeds the sheet at timing at which the toner image matches a leading edge of the sheet. Thereafter, skew feeding of the sheet is corrected by a registration roller 115. Then, the sheet is conveyed to the secondary transfer roller 110.

After transferring the toner image on the sheet, the toner image is fixed to the sheet by a fixing roller 117 and a pressurizing roller 118. A sheet conveying direction is switched by a delivery flapper 119. When a single-sided mode in which the image is formed on one side of the sheet is set, the sheet to which the toner is fixed is conveyed to the intermediate conveying unit 150. Further, when a double-sided mode in which the image is formed on both sides of the sheet is set, the sheet is conveyed to a double-sided sheet surface reverse path 120. The sheet conveyed to the double-sided sheet surface reverse path 120 goes through a double-sided conveying path 123 by a reverse roller 121 and a reverse flapper 122 and conveyed to the registration roller 115. Then, the image is formed on a rear side of the sheet. Thereafter, the sheet is further conveyed to the intermediate conveying unit 150. Thereafter, the sheet is conveyed to a finisher 500 via an intermediate conveying roller 151 of the intermediate conveying unit 150.

[Finisher]

The finisher 500 shown in FIG. 1 performs processing for taking in the sheet conveyed from the printer section 10, processing for aligning a plurality of sheets taken in and bundling the plurality of sheets as one sheet bundle, and stapling processing (binding processing) for stapling a rear edge of the sheet bundle. It means that the finisher 500 performs predetermined post-processing on the sheet received from the image forming apparatus 300. In addition, the finisher 500 has an online post-processing function which performs post-processing on the sheet including sorting processing, non-sorting processing and bookbinding processing. The finisher 500 also has a manual stapling processing function which executes stapling processing on the sheet bundle which is manually inserted through an opening 910. It is noted that a sheet bundle sensor 909 (described later) is arranged on a predetermined position of the opening 910, which detects whether the sheet bundle is manually inserted or not. In the following, description is given with regard to the online post-processing function of the finisher 500.

As shown in FIG. 1, the finisher 500 comprises an inlet roller pair 502 for taking the sheet conveyed from the printer section 10 in the apparatus. A switching flapper 551 for guiding the sheet to a path 552 or a path 553 is arranged on a downstream side of the inlet roller pair 502. When, for example, the post-processing other than the bookbinding processing is performed, the switching flapper 551 guides the sheet to the path 552 shown in FIG. 1. The sheet guided to the path 552 is delivered on an intermediate tray 630 via a conveyance roller 507. The sheet delivered on the intermediate tray 630 is aligned by an alignment plate (not shown) which is arranged at both ends in a width direction which is orthogonal to the sheet conveying direction and by a bundle delivery roller 690. If it is set to perform the binding processing, after the number of sheets forming one bundle is conveyed, the binding processing is performed on the sheet bundle by a stapler 650. Thereafter, the sheet bundle is delivered on the delivery tray 700 through the bundle delivery roller 690.

Further, when the bookbinding processing is performed, the switching flapper 551 guides the sheet to the path 553 shown in FIG. 1. The sheet guided to the path 553 is stored in a storing guide 820 through a conveyance roller 813. It is noted that the sheet which is conveyed by the conveyance roller 813 is conveyed until a leading edge of the sheet contacts a movable sheet positioning member 823.

Further, two pairs of staplers are arranged on a downstream side of the conveyance roller 813, i.e., in the middle position of the storing guide 820 so that a center of the sheet bundle can be bound. It is noted that, to match the stapling position of the sheet bundle bound by the stapler 818 with a nip point of a folding roller pair 826, the positioning member 823 lowers by a predetermined distance from a position at which the stapling processing is performed on the sheet bundle. Thereby, centering on the position at which the stapling processing is performed, the sheet bundle can be folded.

The folding roller pair 826 is arranged on the downstream side of the stapler 818, and a thrusting member 825 is arranged facing the folding roller pair 826. The projecting member 825 protrudes the sheet bundle stored in the storing guide 820. Thereby, the sheet bundle is pushed between the folding roller pair 826 and conveyed while being folded by the folding roller pair 826. Then, the folded sheet bundle passes through an intermediate roller 827 and a delivery roller 828 and then delivered on a delivery tray 832.

[Configuration of Control Unit]

Figure 2:
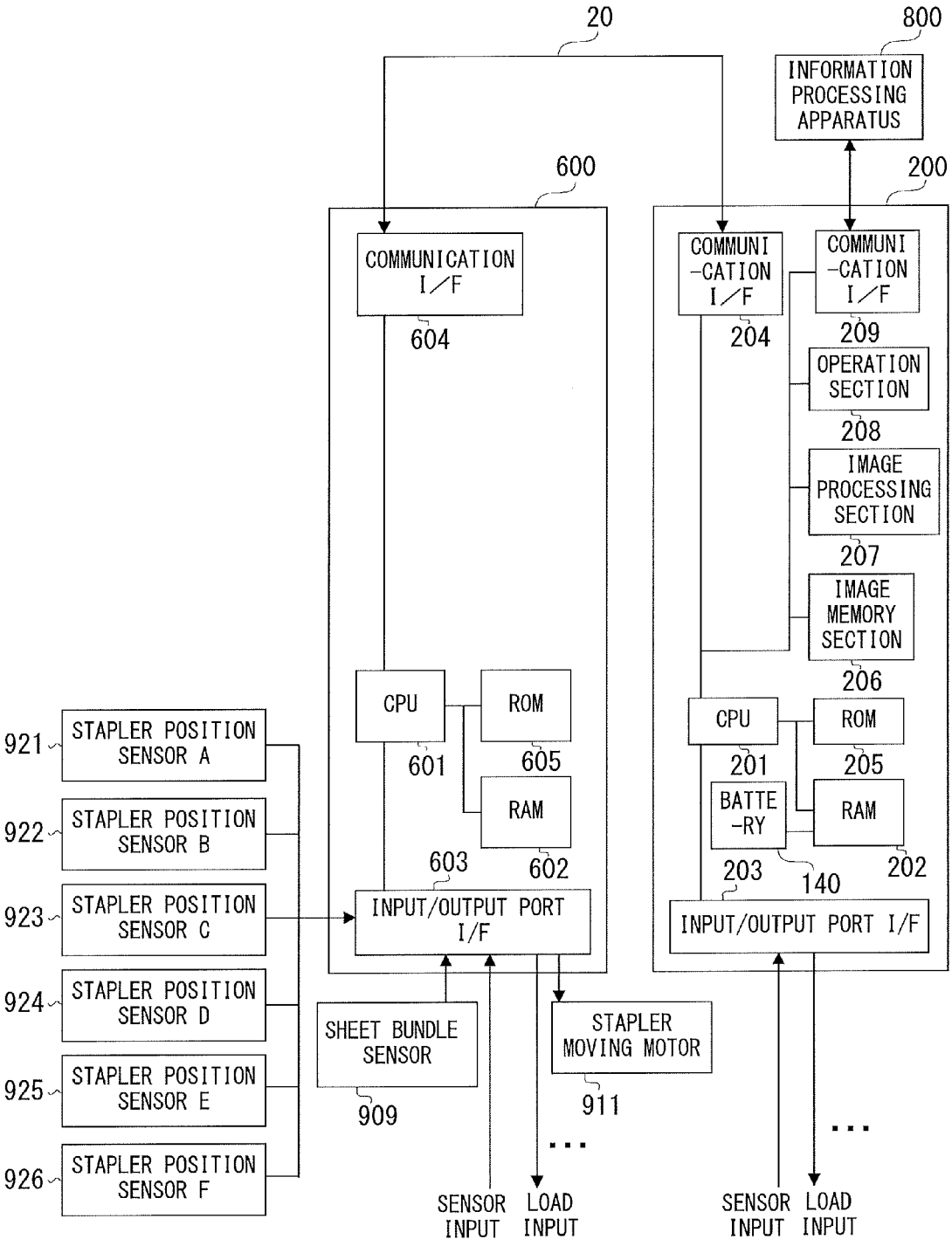
FIG. 2 is a block diagram for explaining a configuration example of a control unit for controlling a printer section and a control unit for controlling the finisher.

FIG. 2 is a block diagram for explaining a configuration of a control unit 200 for controlling the printer section 10 and a control unit 600 for controlling the finisher 500. It is noted that the control unit 200 and the control unit 600 are connected to each other via a communication cable 20 so that bidirectional transmission and reception of information is realized.

The control unit 200 comprises a central processing unit (CPU) 201 for performing basic control of the printer section 10 and a read only memory (ROM) 205 in which a control program or application program is stored. The control unit 200 further comprises a random access memory (RAM) 202 which works as a work area for executing processing of the control program. The control unit 200 further comprises an input/output port IC 203, a communication interface 204, an image memory section 206 for storing image data, an image processing section 207 for processing image signals which are converted into electric signals. The control unit 200 further comprises an operating section 208, a communication interface 209, and a battery 140. It is noted that the battery 140 is connected to the RAM 202. Thereby, data in the RAM 202 is held even when, for example, the printer section 10 is powered off. The input/output port IC 203 is connected to the CPU 201 via an address bus and a data bus.

According to the contents of the control program stored in the ROM 205, the CPU 201 receives signals which are output from sensors and the like (not shown) via the input/output port IC 203 and outputs control signals to various loads such as motors, clutches and the like (not shown). Thereby, sheet conveyance, image formation on the sheet and the like are controlled. Also, the CPU 201 transmits/receives control data to/from the control unit 600 via the communication interface 204 and the communication cable 20. This enables to perform control relating to a delivery accessory device including delivery of the sheet, having the image formed thereon, between the image forming apparatus 300, state display, and the like.

The CPU 201, connected to the operating section 208 for receiving an operation input from the user, controls display of a display section of the operating section 208 and receipt of key input. Through the key input in the operating section 208, the user instructs the operation mode of the printer section 10 and instructs to switch the display of the operating section 208. It is noted that, for example, an operation state of the printer section 10, an operation mode set by the key input and the like are displayed on the display section of the operating section 208.

Further, the control unit 200 is connected to an information processing apparatus 800 via the communication interface 209. The CPU 201 controls to store the image data transferred from the information processing apparatus 800 in the image memory section 206 and cause the image processing section 207 to process the image based on the image data. When a print job (online job) involving execution of stapling in a manual mode (second control mode, described later) is instructed via the information processing apparatus 800 and the operating section 208, the control unit 200 notifies the control unit 600 of the online job.

The control unit 600 comprises a CPU 601 which performs basic control of the finisher 500, a ROM 605 in which control program or application program is stored, and a RAM 602 which works as a work area for executing processing of the control program. The control unit 600 further comprises an input/output port IC 603, and a communication interface 604. It is noted that the input/output port IC 603 is connected to the CPU 601 via an address bus and a data bus.

According to the contents of the control program stored in the ROM 605, the CPU 601 receives signals which are output from sensors and the like (not shown) via the input/output port IC 603 and outputs control signals to various loads such as motors, clutches and the like (not shown). Thereby, sheet conveyance, post-processing on the sheet and the like are controlled. Further, the sheet bundle sensor 909, stapler moving motor 911, various sensors and the like are connected to the input/output port IC 603. The CPU 601 transmits/receives control data to/from the control unit 200 via the communication interface 604. Thereby, the operation control of the online post-processing function including delivery, post processing and the like of the sheet which is conveyed from the printer section 10 are performed based on, for example, an online job notification. The CPU 601 further notifies the control unit 200 of whether the finisher 500 prohibits the execution of the online post-processing function or not. Next, description is given with regard to a processing position of the stapler 650, movement to the processing position when the online stapling is performed and the like.

Figure 3:
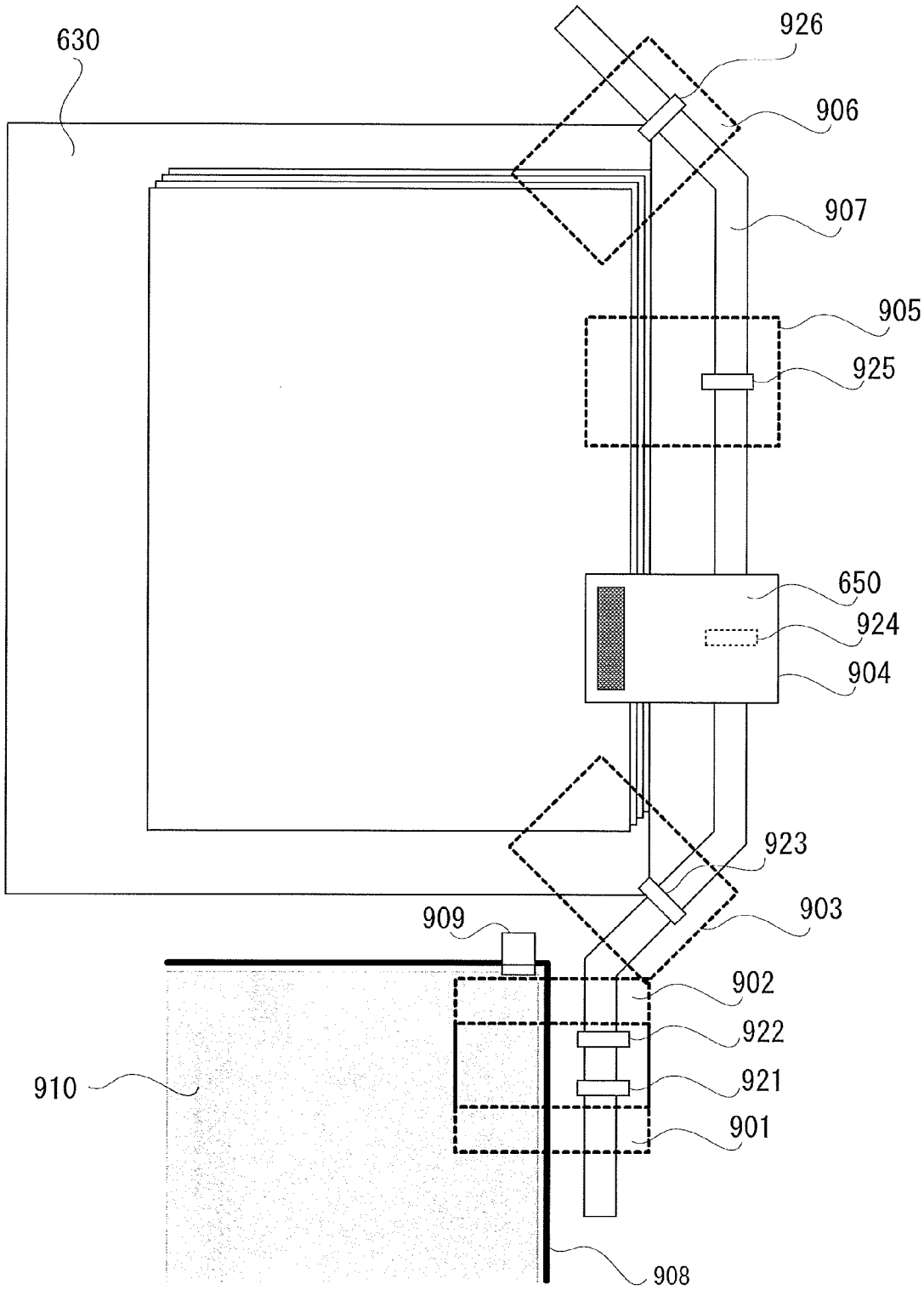
FIG. 3 is a top view illustrating a configuration example of a stapling section including a stapler.

FIG. 3 is a top view illustrating one example of a configuration of a stapling section including the stapler 650. The stapler 650 is configured to be movable along a guide rail 907 when a stapler moving motor 911 shown in FIG. 2 drives a stapler moving belt (not shown). In addition, the stapler 650 is configured not to interfere with sheet conveyance in the path 552 while it moves, sheet delivery on the intermediate tray 630 and the like. Further, when executing the online stapling, the stapler 650 is configured to allow performing post-processing including corner binding, by which a corner of the sheet is bound, double stapling, by which two portions of the rear edge of the sheet are bound and the like. Further, a position at which the stapler stops on the belt includes a home position 901, a front corner binding position 903, a front double binding position 904, a rear double binding position 905, a rear corner binding position 906 and the like. As mentioned, according to the contents of the post-processing, the stapler 650 stays at the respective processing position. It is noted that FIG. 3 shows a state where the stapler 650 stays at the front double binding position 904.

The stapler 650 is controlled to stay at the home position 901 in a normal state, move to the position according to the instruction of the respective binding positions (902 to 906) to perform the binding processing, and go back to the home position 901 after performing the binding processing. For example, when the stapler 650 is moved from the home position 901 to the rear corner binding position 906, the CPU 601 instructs the stapler moving motor 911 to start driving via the input/output port IC 603. Thereafter, the CPU 601 receives a detection result of a stapler position sensor F 926 via the input/output port IC 603 and instructs the stapler moving motor 911 to stop driving. Thereby, the stapler 650 becomes ready to execute the binding processing (post-processing) at the rear corner binding position 906. The stapler 650 stands by in that state by the timing at which the binding processing is executed. It is noted that, similar to the above, the CPU 601 controls the movement toward each position 901 to 905. Next, description is given with regard to executing the manual stapling by the stapler 650.

Figure 4:
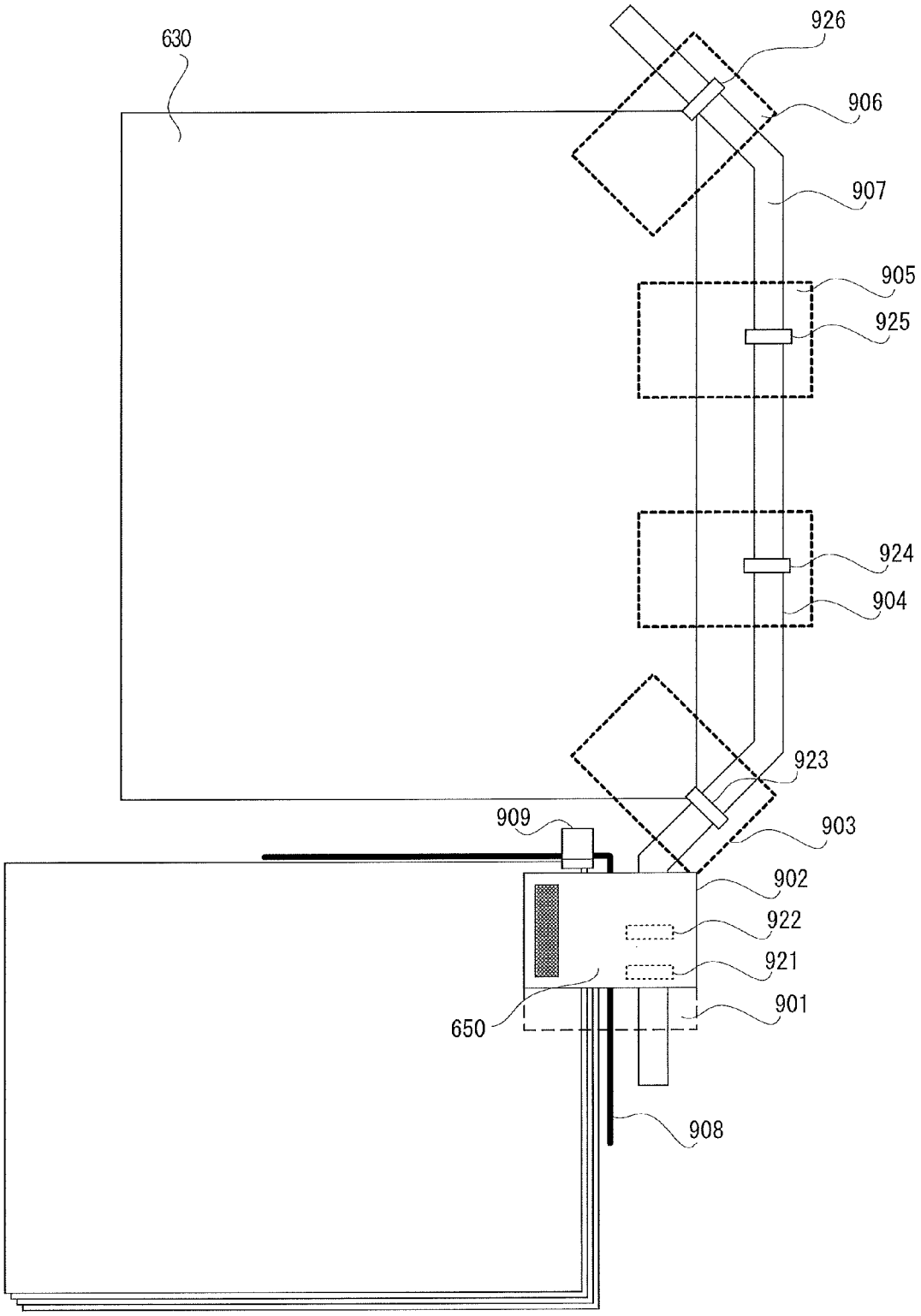
FIG. 4 is a diagram illustrating a state in which the stapler stays at a position where the stapler executes manual stapling.

FIG. 4 is a diagram illustrating a state in which the stapler 650 stays at a position where the stapler 650 executes the manual stapling processing. The sheet bundle sensor 909 shown in FIG. 4, arranged near a guide board 908, detects that the sheet bundle is inserted into the opening 910 of the finisher 500 from outside. When the sheet bundle sensor 909 changes from a non-detection state to a detection state of the insertion of the sheet bundle, the CPU 601 moves the stapler 650 staying at the home position 901 to the manual stapling position 902. Further, the stapler 650 having performed the binding processing at the manual stapling position 902 goes back again to the home position 901. In the following, description is given with regard to a processing procedure of the finisher 500 according to the present embodiment using FIGS. 5 to 8.

[Control Procedure with Regard to Online Job Notification]

Figure 5:
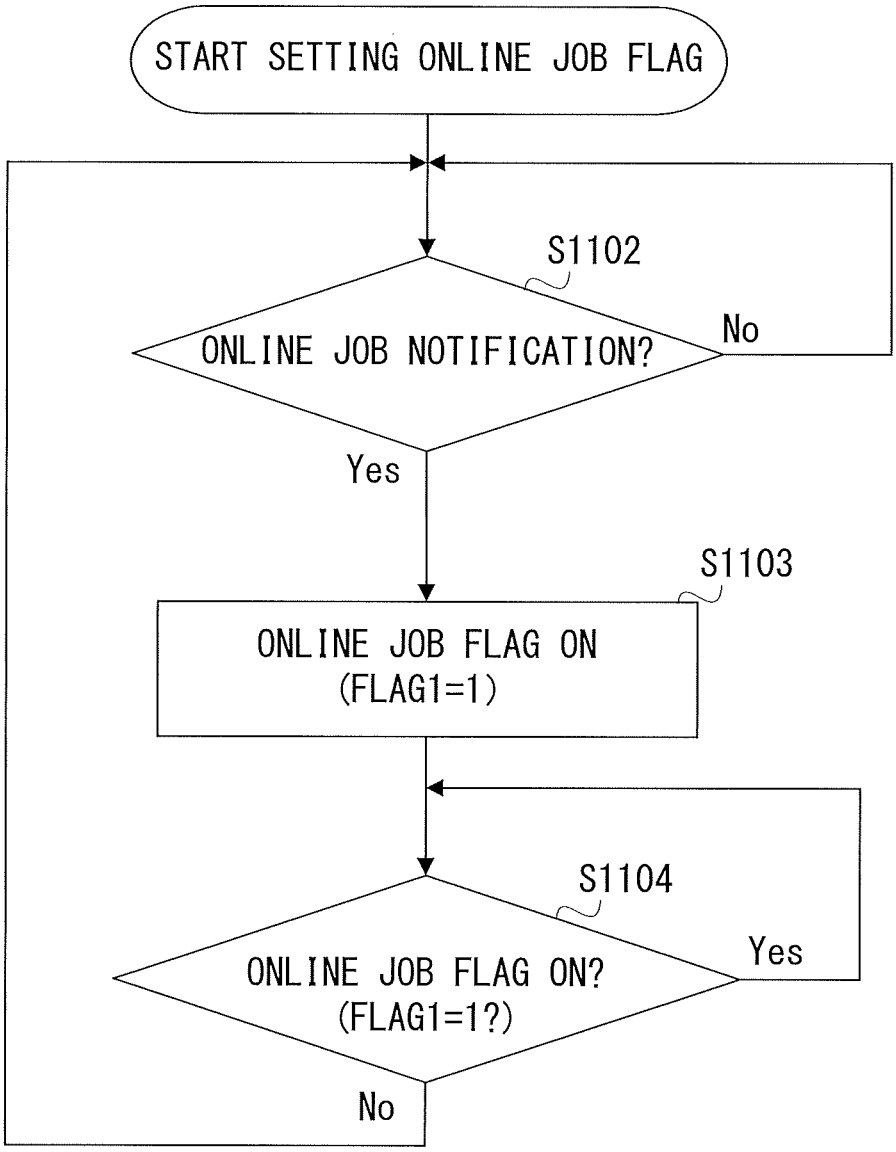
FIG. 5 is a flowchart illustrating one example of a processing procedure for determining whether the control unit for controlling the finisher received an online job notification or not.

FIG. 5 is a flowchart illustrating one example of the processing procedure for determining whether the control unit 600 received a print job (online job) notification specifying to perform stapling or not. Each processing shown in FIG. 5 is mainly performed by the CPU 601. Further, the CPU 601 stores the fact that the online job is notified to the control unit 600 on the RAM 602 as an online job flag.

The CPU 601 starts to set the online job flag. It is noted that the setting of the online job flag is started immediately after the power is on, which keeps operating until the power is off. The CPU 601 determines whether the online job notification is received or not (S1102). If it is determined that the online job notification is received (S1102: Yes), the online job flag is turned ON (Flag1=1) (S1103). It is noted that the processing of the Step S1102 is repeated until the online job notification is received. The CPU 601 determines whether the online job flag is ON or not (S1104). This is the processing to prohibit receiving the online job notification from the online job notification to the control unit 600 to turning OFF the online job flag (Flag1=0). When the online job flag is turned OFF (S1104: No), the CPU 601 goes back to the processing of Step S1102.

[Control Procedure Relating to Switching Between Manual Mode and Online Mode]

Both the manual staple and the online staple operations need the stapler 650, however, the finisher has only one stapler 650. Therefore, it is not possible to execute the manual stapling and the online stapling at the same time. Thus, the control unit 600 switches two exclusive operation modes, i.e., the manual mode which uses the stapler 650 as the manual staple and the online mode (first control mode) which uses the stapler 650 as the online staple. For example, the operation mode when the manual stapling is executed is set as the manual mode, during which, it is allowed to execute the manual stapling and it is controlled to prohibit executing the online stapling. In the online mode, it is allowed to execute the online stapling, and it is controlled to prohibit executing the manual stapling. In the following, description is given with regard to the control procedure using FIG. 6.

Figure 6:
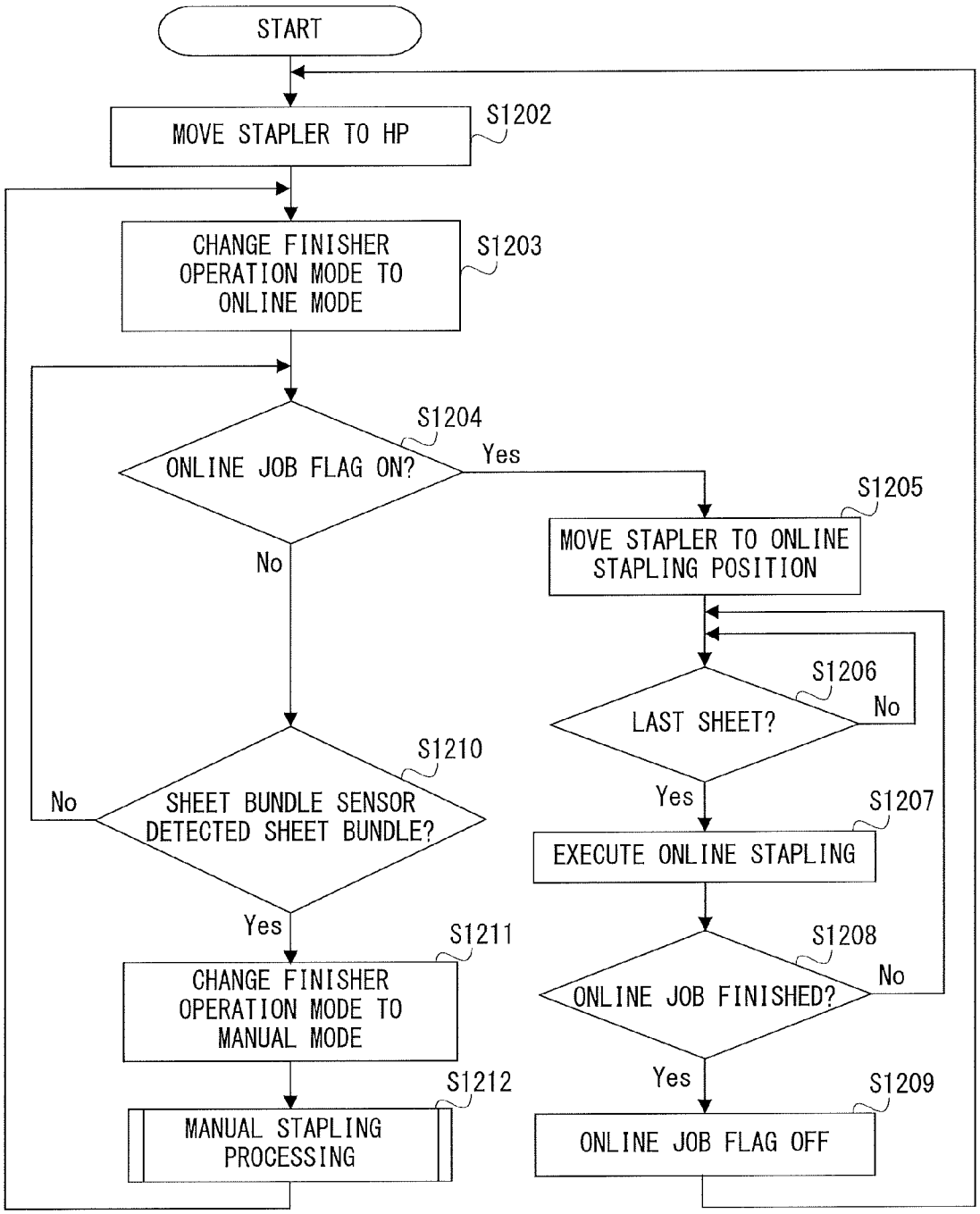
FIG. 6 is a flowchart for explaining an exclusive control of two operation modes, i.e., a manual mode and an online mode.

FIG. 6 is a flowchart for explaining an exclusive control of the two operation modes, i.e., the manual mode and the online mode. It is noted that each processing shown in FIG. 6 is started by reading and executing, by the CPU 601, mode switching control program stored, for example, in the ROM 605.

The CPU 601 drives the stapler moving motor 911 to move the stapler 650 to the home position 901 (S1202). The CPU 601 sets the finisher operation mode to the online mode (S1203). It is noted that the setting of the finisher operation mode to the online mode is stored in a finisher operation mode storage area on the RAM 602. The CPU 601 determines whether the online job flag is ON or not (S1204). If it is determined that the online job flag is ON (Flag1=1) (S1204: Y), the CPU 601 proceeds to processing of Step S1205. If not (S1204: No), the CPU 601 proceeds to the processing of Step S1208.

The CPU 601 drives the stapler moving motor 911 to move the stapler 650 from the home position 901 to the online stapling position specified by the print job (S1205). The CPU 601 determines whether a last sheet of the sheet bundle subjected to the online stapling processing reaches the processing position or not (S1206). If it is determined that the last sheet reaches the processing position (S1206: Yes), the CPU 601 executes the online stapling processing by the stapler 650 (S1207).

The CPU 601 determines whether the online job is finished or not (S1208). If it is determined that the online job is not finished (S1208: No), the CPU 601 goes back to the processing of Step S1206. If not (S1208: Yes), that is, if it is determined that the online job is finished, the CPU 601 turns OFF the online job flag (Flag1=0) and goes back to the processing of Step S1202.

The CPU 601 determines whether the sheet bundle sensor 909 detected the insertion of the sheet bundle or not. In this processing, it is determined whether a condition to shift to the manual mode is satisfied or not. If the sheet bundle is not detected (S1210: No), the CPU 601 goes back to the processing of Step S1204. If the sheet bundle is detected (S1210: Yes), the CPU 601 sets/changes the finisher operation mode to the manual mode (S1211). Through the above mentioned processing, the manual stapling processing is ready to be executed. The CPU 601 executes the manual stapling processing (S1212) and goes back to the processing of Step S1203. It is noted that the detail of the manual stapling processing is described later using FIG. 7. Through the above mentioned processing, switching between the online mode and the manual mode is controlled. It is noted that when the online job is being executed by the image forming apparatus 300, shift to the manual mode is controlled in each processing of Steps S1206 to S1208. Further, if the operation mode is shifted to the manual mode in the processing of Step S1211, execution of the online job is controlled and exclusive processing of the both modes is realized. Next, description is given with regard to the manual stapling processing (S1212) using FIG. 7 in detail.

[Control Procedure Relating to Manual Stapling]

Figure 7:
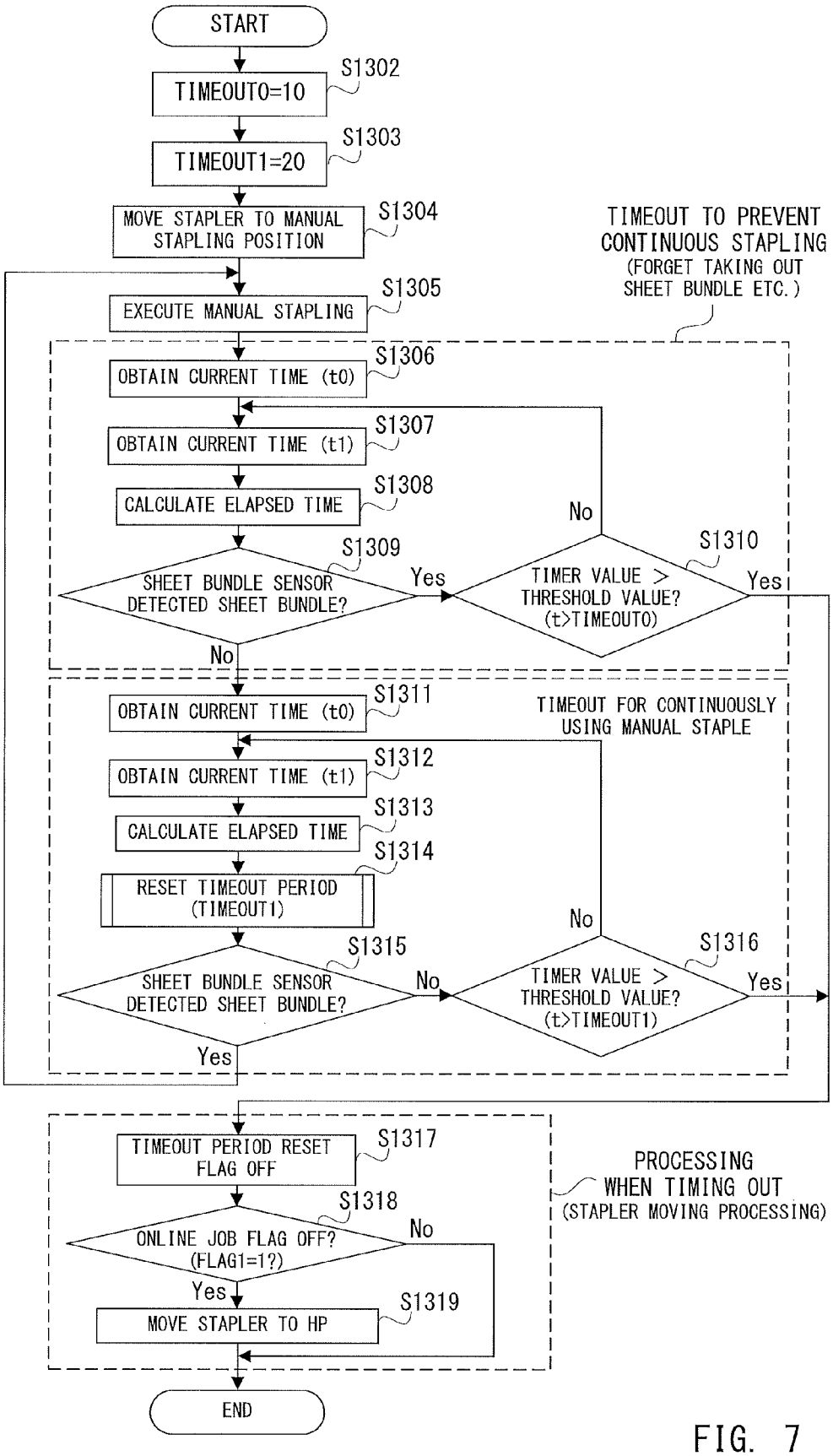
FIG. 7 is a flowchart illustrating one example of a particular processing procedure of manual stapling processing.

FIG. 7 is a flowchart illustrating one example of a particular processing procedure of the manual stapling processing. The CPU 601 sets 10 [sec] as a timeout period of TimeOut0 (S1302). After executing the manual stapling, in a case where, for example, it takes time to take out the sheet bundle which is manual stapled, there may be a case where the stapling processing is continuously executed on the same sheet bundle. The timeout period of TimeOut0 is a standby time set to prevent the stapling processing from being continuously executed on the same sheet bundle. The CPU 601 sets 20 [sec] (i.e., first predetermined period) as a timeout period of TimeOut1 (S1303). The timeout period of TimeOut1 is a standby time set when executing the manual stapling again after executing the manual stapling. It is noted that the set value of the timeout periods of TimeOut0 and TimeOut1, is not limited to the above set value.

The CPU 601 drives the stapler moving motor 911 and moves the stapler 650 from the home position 901 to the manual stapling position 902 (S1304). After the stapler 650 has moved to the manual stapling position 902, the CPU 601 executes the manual stapling processing on the sheet bundle (S1305). Each processing of Steps S1306 to S1310 in the following is a control procedure for preventing the stapling processing from being continuously performed on the same sheet bundle due to the time taken to take out the sheet bundle and the like.

The CPU 601 obtains time using a built-in timer and sets the time obtained as measurement start time TO (S1306). Thereafter, the CPU 601 obtains the time again and sets the time obtained as halfway time t1 (S1307). Based on the measurement start time t0 and the halfway time t1, the CPU 601 obtains elapsed time t by t1−t0 and determines the obtained result as a timer value (S1308). It is noted that the measurement start time t0, the halfway time t1 and the timer value are stored in the RAM 602.

Based on the detection result of the sheet bundle by the sheet bundle sensor 909, the CPU 601 determines whether or not the sheet bundle having executed the manual stapling processing thereon is pulled out or not (S1309). If the sheet bundle is not detected by the sheet bundle sensor 909 (S1309: No), the CPU 601 proceeds to Step S1311. Otherwise (S1309: Yes), that is, if the sheet bundle is detected by the sheet bundle sensor 909, the CPU 601 determines whether the timer value (elapsed time t) exceeds the value of the timeout period of TimeOut0 or not (S1310). If it is determined that the timer value does not exceed the timeout period of TimeOut0 (t=<TimeOut0, S1310: No), that is, if it is before the lapse of the timeout period of TimeOut0, the CPU 601 goes back to the processing of Step S1307. If not (t>TimeOut0, S1310: Yes), that is, if it is after the lapse of the timeout period of TimeOut0, the CPU 601 proceeds to the processing of Step S1317. Thereafter, the CPU 601 performs processing after the timeout.

Each processing of Steps S1311 to S1316 is a control procedure when, after executing the manual stapling processing, executing the manual stapling processing again. The CPU 601 obtains time using a timer (not shown) and sets the time obtained as measurement start time t0 (S1311). Thereafter, the CPU 601 obtains the time again and sets the time obtained as halfway time t1 (S1312). Based on the measurement start time t0 and the halfway time t1, the CPU 601 determines elapsed time t, obtained by t1−t0, as a timer value (elapsed time t=t1−t0) (S1313). It is noted that the measurement start time t0, the halfway time t1 and the timer value are stored in the RAM 602.

The CPU 601 resets the timeout period (TimeOut1) (S1314). It is noted that the present processing is the processing for resetting the timeout period set in the processing of the Step S1303 based on the online job flag. Detail of the processing will be described later using FIG. 8.

The CPU 601 determines whether the sheet bundle is inserted or not based on the detection result of the sheet bundle by the sheet bundle sensor 909 (S1315). If the sheet bundle is detected by the sheet bundle sensor 909 (S1315: Yes), the CPU 601 goes back to the processing of Step S1305 and executes the manual stapling processing. If not (S1315: No), the CPU 601 determines whether the timer value (elapsed time t) exceeds the value of the timeout period of TimeOut1 or not (S1316). If it is determined that the timer value does not exceed the timeout period of TimeOut1 (t=<TimeOut1, S1316: No), that is, if it is before the lapse of the timeout period of TimeOut1, the CPU 601 goes back to the processing of Step S1312. Otherwise (t>TimeOut1, S1316: Yes), that is, if it is after the lapse of the timeout period of TimeOut1, the CPU 601 proceeds to the processing of Step S1317. In this case, it means that the manual stapling is not continuously executed. Thereafter, the CPU 601 performs processing after the timeout.

Each processing of Steps S1317 to S1319 is the processing after the timeout as previously described. The processing after the timeout is the processing to change the moving position of the stapler 650 according to presence/absence of the online job. The CPU 601 turns OFF a timeout period reset flag (Flag2=0) used to determine whether to reset the timeout period or not in the processing of Step S1314 (S1317). Use of the timeout period reset flag will be described later using FIG. 8.

The CPU 601 determines whether the online job flag is OFF (Flag1=0) or not (S1318). Here, according to a notification state of the online job, the CPU 610 determines which position to move the stapler 650 from the manual stapling position. If it is determined that the online job flag is OFF (Flag1=0) (S1318: Yes), the CPU 601 moves the stapler 650 to the home position 901 (S1319). If not (S1318: No), that is, if it is determined that the online job flag is ON (Flag1=1), the CPU 601 ends a series of the processing.

[Processing Procedure for Resetting Timeout Period]

Figure 8:
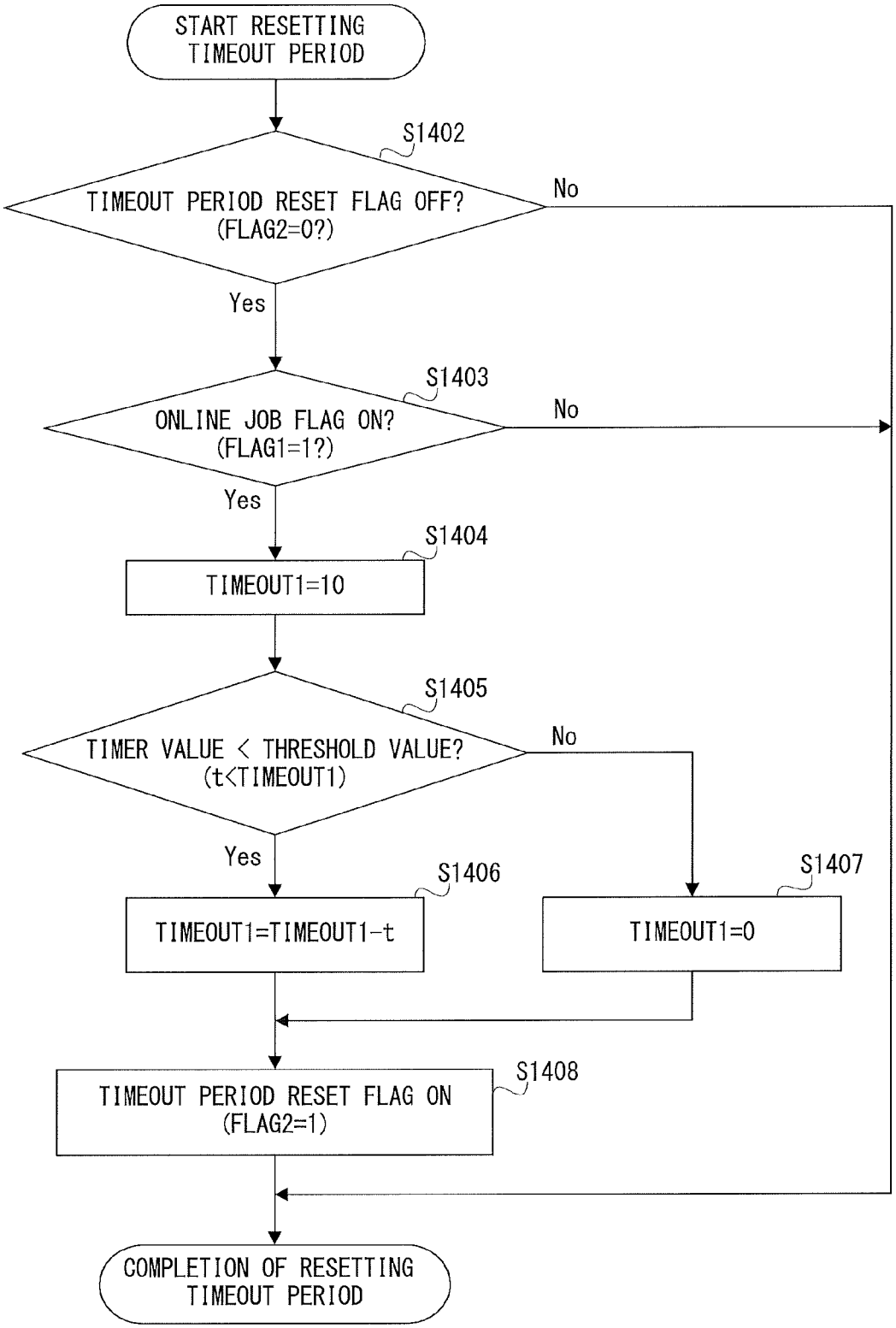
FIG. 8 is a flowchart for explaining resetting timeout period when the online job is received when it is in the manual mode.

Next, description is given with regard to resetting the timeout period in a case where the online job notification is received during the manual mode, which is one of the features of the present invention, using a flowchart shown in FIG. 8. It is noted that, in the present processing, once the timeout period of TimeOut1 is reset, until the timeout period expires, the timeout period of TimeOut1 is prohibited from being newly reset. Thereby, a timeout period reset flag (Flag2) is used. Further, whether the timeout period elapsed or not is determined based on, for example, the measurement result measured by the timer (not shown) controlled by the CPU 601.

The CPU 601 determines whether the timeout period reset flag (Flag2) is OFF or not (S1402). If it is determined that the timeout period reset flag is OFF (S1402: Yes), it is determined whether the online job flag is ON (Flag1=1) or not. If not (S1402: No), the CPU 601 ends the processing. If it is determined that the online job flag is ON (Flag1=1) (S1403: Yes), the CPU 601 proceeds to the processing of Step 1404. If not (S1403: No), that is, if it is determined that the online job flag is OFF (Flag1=0), the CPU 601 does not reset the timeout period and ends the processing.

The CPU 601 resets a period shorter than 20 [sec] (for example, 10 [sec]: second predetermined period) which is set as the timeout period of TimeOut1 in the processing of Step S1303 as the timeout period of TimeOut1 (S1404). It is noted that the reset value of the timeout period is not limited to 10 [sec]. Further, the timeout period of TimeOut1 as reset will be the threshold value in the following processing.

Each processing of Steps S1405 to S1407 is the processing to reset the timeout period of TimeOut1 in a case where the manual stapling is executed a plurality of times and the online job notification is received within the timeout period from completion of the second and subsequent manual stapling. The CPU 601 compares the elapsed time t, which is the time value, with the value of the timeout period of TimeOut1 (threshold value) set in the processing of Step S1404 (S1405).

When the elapsed time t does not exceed the timeout period of TimeOut1 set in the processing of Step S1404 (t<TimeOut1, S1405: Yes), the CPU 601 sets the value obtained by (TimeOut1−t) [sec] as the timeout period of TimeOut1 (S1406). It is noted that the difference between TimeOut1 and t [sec] is a third predetermined period. For example, if the elapsed time t is 0 [sec] from the start of the continuous use of the manual staple, 10 [sec] is set as the timeout period of TimeOut1. Further, if the elapsed time t is 4 [sec] from the start of the continuous use of the manual staple, 6 [sec] is set as the timeout period of TimeOut1.

If not (S1405: No), that is, if the elapsed time t exceeds the timeout period of TimeOut1 set in the processing of Step S1404 (t≥TimeOut1), the CPU 601 proceeds the processing of Step S1407. The CPU 601 sets 0 (zero) [sec] as the timeout period of TimeOut1 (third predetermined period)

(S1407). For example, in a case where the online job notification is received after the lapse of 15 [sec] from the start of the continuous use of the manual staple, it is possible to immediately time out and start to execute the online job. The CPU 601 turns ON the timeout period reset flag (Flag2) (S1408). Thereby, until the timeout period as set (third predetermined period) elapses, it is prohibited the timeout period of from being newly reset.

As mentioned, in the image forming system S according to the present embodiment, the timeout period for a case where the online job notification is received during the manual mode is set to be shorter than the timeout period for a case where the online job notification is not received. This enables to realize normal usability for the user using the manual staple as long as the online job is not notified and reduce any useless standby time for the user using the online staple. It is noted that, in the present embodiment, description has been given with regard to the image forming system S comprising the image forming apparatus 300 and the finisher 500. Not limited to this, in the image forming apparatus, components included in the image forming apparatus 300 and components included in the finisher 500 may be integrated. Further, the control unit 600 may be configured to directly receive the online job instructed from the information processing apparatus not via the control unit 200.

The above embodiments are only the examples to specifically explain the present invention. Therefore, the scope of the invention is not limited to these embodiments.

As described above, according to the present disclosure, the control unit is configured to switch, when it is in the manual mode, which is the second control mode, to the first control mode after a lapse of the second predetermined period in a case where the control unit receives a print job (hereinafter referred to as online job) notification involving execution of online stapling which is executed in the first control mode. This enables to realize normal usability for the user using the manual staple as long as the online job is not notified and reduce any useless standby time for the user using the online staple.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-137574, filed Jul. 3, 2014, which is hereby incorporated by reference wherein in its entirety.

What is claimed is:

1. A post-processing apparatus connected to an image forming apparatus, the post-processing apparatus comprising:

a post-processing unit configured to perform predetermined post-processing on a sheet; and a control unit configured to switch between a first control mode and a second control mode, the first control mode being a mode for allowing the predetermined post-processing on a sheet which is conveyed from the image forming apparatus, and the second control mode being a mode for allowing the predetermined post-processing on a sheet which is manually inserted into the post-processing apparatus, the control unit being further configured to control the switching such that the control unit switches the mode from the second control mode to the first control mode after a lapse of a first predetermined period from completion of the post-processing in the second control mode, wherein, in a case where the control unit receives a notification from the image forming apparatus notifying to perform an image formation to which post-processing in the first control mode is specified, the control unit is further configured to switch, when it is in the second control mode, to the first control mode after a lapse of a second predetermined period, which is shorter than the first predetermined period.

2. The post-processing apparatus according to claim 1, wherein the processing position of the post-processing unit in the first control mode is different from the processing position of the post-processing unit in the second control mode, and wherein the post-processing apparatus further comprises a moving unit configured to move the post-processing unit to a processing position according to each control mode.

3. The post-processing apparatus according to claim 1, further comprising:

a detection unit configured to detect the sheet which is manually inserted, wherein the control unit is further configured to set a control mode to the second control mode in a case where the state of the detection unit changes from a non-detected state to a detected state of the sheet.

4. The post-processing apparatus according to claim 1, wherein the control unit is further configured to:

1) switch to the first control mode after a lapse of the second predetermined period in a case where the control unit receives the notification from the image forming apparatus, the notification notifying to perform an image formation, to which post-processing in the first control mode is specified, before the second predetermined period elapses from completion of the predetermined post-processing in the second control mode, and 2) switch to the first control mode without waiting for a lapse of the first predetermined period in a case where the control unit receives the notification after a lapse of the second predetermined period from completion of the predetermined post-processing in the second control mode.

5. The post-processing apparatus according to claim 4, further comprising:

a measurement unit configured to measure an elapsed time from completion of the predetermined post-processing in the second control mode to the receipt of the notification, wherein the control unit is further configured to:

1) set a difference between the second predetermined period and the measurement result as a third predetermined period in a case where a measurement result of the measurement unit is smaller than the second predetermined period;

2) set 0 (zero) as the third predetermined period in a case where the measurement result exceeds the second predetermined period; and 3) switch the mode of the post-processing unit to the first control mode after a lapse of the third predetermined period from the receipt of the notification.

6. The post-processing apparatus according to claim 5, wherein the control unit is further configured to prohibit the third predetermined period from being reset until the third predetermined period as set elapses.

7. An image forming system including an image forming apparatus for forming an image on a sheet and a post-processing apparatus for performing predetermined post-processing on a sheet, wherein the post-processing apparatus comprises:

a post-processing unit configured to perform predetermined post-processing on a sheet; and a control unit configured to switch between a first control mode and a second control mode, the first control mode being a mode for allowing the predetermined post-processing on a sheet which is conveyed from the image forming apparatus, and the second control mode being a mode for allowing the predetermined post-processing on a sheet which is manually inserted into the post-processing apparatus, the control unit being further configured to control the switching such that the control unit switches the mode from the second control mode to the first control mode after a lapse of a first predetermined period from completion of the post-processing in the second control mode, wherein, in a case where the control unit receives a notification from the image forming apparatus notifying to perform an image formation to which post-processing in the first control mode is specified, the control unit is further configured to switch, when it is in the second control mode, to the first control mode after a lapse of a second predetermined period, which is shorter than the first predetermined period.

8. A post-processing apparatus connected to an image forming apparatus, the post-processing apparatus comprising:

a post-processing unit configured to perform predetermined post-processing on a sheet;

a control unit configured to switch between a first control mode and a second control mode, the first control mode being a mode for allowing the predetermined post-processing on a sheet which is conveyed from the image forming apparatus, and the second control mode being a mode for allowing the predetermined post-processing on a sheet which is manually inserted into the post-processing apparatus; and a detection unit configured to detect the sheet which is manually inserted, wherein the control unit is further configured to change, when in the second control mode, a standby time from completion of a latest post-processing until a start of next post-processing, in accordance with a detection result of the detection unit.

9. The post-processing apparatus according to claim 8, wherein the control unit is further configured to switch, when in the second control mode, the mode from the second control mode to the first control mode after a lapse of an original standby time, in a case where the detection unit detects the sheet after the post-processing and the original standby time elapses.

10. The post-processing apparatus according to claim 8, wherein the control unit is further configured to switch, when the standby time is changed when in the second control mode, the mode from the second control mode to the first control mode when the sheet is not detected by the detection unit and after a lapse of the changed standby time.

11. The post-processing apparatus according to claim 10, wherein the changed standby time is longer than an original standby time.

* * * * *